US006641114B1

(12) United States Patent
Davis

(10) Patent No.: US 6,641,114 B1
(45) Date of Patent: Nov. 4, 2003

(54) MAGNETIC STAPLE REMOVER

(76) Inventor: Carmen Denice Davis, 1910 Charles St., Indianapolis, IN (US) 46225

( * ) Notice: Subject to any disclaimer, the term of this patent is extended or adjusted under 35 U.S.C. 154(b) by 0 days.

(21) Appl. No.: 10/266,198

(22) Filed: Oct. 7, 2002

(51) Int. Cl.[7] ..... B25C 11/00
(52) U.S. Cl. ..... 254/28
(58) Field of Search ..... 254/28, 25, 18

(56) References Cited

U.S. PATENT DOCUMENTS 3,974,999 A * 8/1976 Bertolet ..... 254/18
5,957,430 A * 9/1999 Olson ..... 254/18
6,105,936 A * 8/2000 Malek ..... 254/18
6,409,152 B1 * 6/2002 Bagley ..... 254/18

* cited by examiner

*Primary Examiner*—Lee D. Wilson

(57) ABSTRACT

A staple remover that retains waste staples and holds them using a magnetic field until they can be disclosed is provided. The magnetic staple remover comprising an upper hemisphere having teeth, which extend from the front face and a lower hemisphere having teeth, which extend from the front face. The rear face of the lower hemisphere is pivotally attached to the rear face of the upper hemisphere and a magnet is located on the interior surface of the lower hemisphere. A cup is adapted to fit into the interior surface of the lower hemisphere above the magnet. Preferably, the magnetic staple remover also comprises a slot in the cup and an ejection tit in the upper hemisphere. This ejection tit rotates into the slot when the upper hemisphere is rotated away from the lower hemisphere as the staple remover is fully opened.

18 Claims, 1 Drawing Sheet

MAGNETIC STAPLE REMOVER

BACKGROUND OF THE INVENTION

1. Field of the Invention

The present invention relates to a staple remover for use in connection with removing staples and simultaneously removing the used staples. The magnetic staple remover has particular utility in connection with simple and efficient removal of staples without the need to gather and dispose of the waste staples.

2. Description of the Prior Art

Staple removers are desirable for removing staples so that stapled papers can be separated. A means of holding the released staple is also important in that staples are small and easily misplaced. When staple are removed from paper or other surface which had been fastened with the staple, they tend to randomly fly away from their prior location. In addition, staples tend to accumulate in crevices on a desk or on the floor where it is difficult or time-consuming to remove them. The staples are frequently caught up in the papers previously bound together and must be removed carefully if the papers are to be placed in a photocopier to prevent damage to the photocopier. It is therefore advantageous to provide a means for retaining the waste staples after they have been removed form the paper or other material.

The use of magnetized staple removers are known in the prior art. For example, U.S. Pat. No. 4,054,263 to Delia discloses a standard style staple remover with two pivotal arms ending in a pincher having magnetic plates behind the pinchers forming a cavity into which the staples can fall. However, Delia's patent does not provide a cup or other recess isolated for the collection of staples where the staples can not be easily dislodged during use and easily discarded, and has further drawbacks of not providing a rounded outer body style.

U.S. Pat. No. 5,957,430 to Olson discloses a standard style magnetized staple remover having a plurality of magnets laterally outside of the pincher elements to capture and hold the staples once they have been removed. U.S. Pat. No. 3,974,999 to Bertolet discloses a standard style staple removing and retrieval device having a permanent magnet in the pincher elements that retain the staples. U.S. Pat. No. 6,105,936 to Malek discloses a staple remover that uses the heel of the palm to facilitate a more natural action for removing staples and optionally has a magnet located below the pincher element. Lastly, U.S. Pat. No. 4,553,737 to Yi discloses a prying staple remover with a magnet in the head portion for retaining staples.

None of these patents provide for a cup or other recessed area that can hold the staples without the concern on knocking them off the magnet or magnets. They are limiting in that the user must often remove the staples collecting on the magnet to eliminate accidentally brushing the staples off the magnet. Further, none of these patents provides for a convenient means to dispose of the staples, requiring the user to brush the staples off the magnet, countering the magnetic pull and subjecting fingers to potential harm on the sharp edges of the staple removers known in the art. Additionally, the patents described hereinabove do not provide a rounded outer body style that is pleasing to the eye as well as comfortable to grip.

While the above-described devices fulfill their respective, particular objectives and requirements, the aforementioned patents do not describe a magnetic staple remover that allows the user to automatically collect staples once they have been removed from fastening paper or another material into a cup or other recess area that can be removed to facilitate disposal of the waste staples. Also, the above-mentioned patents make no provision for a rounded body for the staple remover.

Therefore, a need exists for a new and improved magnetic staple remover that can be used for removing staples and retaining the staple within the remover for easy disposal. In this regard, the present invention substantially fulfills this need. In this respect, the magnetic staple remover according to the present invention substantially departs from the conventional concepts and designs of the prior art, and in doing so provides an aesthetically pleasing apparatus primarily developed for the purpose of removing and retaining staples.

SUMMARY OF THE INVENTION

In view of the foregoing disadvantages inherent in the known types of staple removers now present in the prior art, the present invention provides an improved magnetic staple remover, and overcomes the above-mentioned disadvantages and drawbacks of the prior art. As such, the general purpose of the present invention, which will be described subsequently in greater detail, is to provide a new and improved magnetic staple remover and method which has all the advantages of the prior art mentioned heretofore and many novel features. This results in a magnetic staple remover that is not anticipated, rendered obvious, suggested, or even implied by the prior art, either alone or in any combination thereof.

To attain this, the present invention essentially comprises a magnetic staple remover comprising an upper hemisphere having teeth, which extend from the front face and a lower hemisphere having teeth extend from the front face. The rear face of the lower hemisphere is pivotally attached to the rear face of the upper hemisphere. This attachment is, for example, a pin and spring or a ball detent and recess. The staple remover also has a magnet on the interior surface of the lower hemisphere and a cup adapted to fit into the interior surface of the lower hemisphere above the magnet. Preferably, the magnetic staple remover also comprises a slot in the cup and an ejection tit in the upper hemisphere. This ejection tit rotates into the slot when the upper hemisphere is rotated away from the lower hemisphere as the staple remover is fully opened.

There has thus been outlined, rather broadly, the more important features of the invention in order that the detailed description thereof that follows may be better understood and in order that the present contribution to the art may be better appreciated.

The invention may also include a gel grip on the top of said upper hemisphere for ease in gripping the staple remover.

In one embodiment, the staple remover is approximately 4–5 inches in diameter and approximately 2.5 inches tall. The two hemispheres may be formed from a colored hard plastic. Other moldable materials are also appropriate. Similarly, the gel grip may also be colored to make the staple remover more aesthetically appealing.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. In addition, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. For example, a staple remover that is substantially oval is also contemplated in the current invention.

It is therefore an object of the present invention to provide a new and improved magnetic staple remover that has all of the advantages of the prior art staple removers and none of the disadvantages.

It is another object of the present invention to provide a new and improved magnetic staple remover that may be easily and efficiently manufactured and marketed.

An even further object of the present invention is to provide a new and improved magnetic staple remover that has a low cost of manufacture with regard to both materials and labor, and which accordingly is then susceptible of low prices of sale to the consuming public, thereby making such magnetic staple remover economically available to the buying public.

Still another object of the present invention is to provide a new magnetic staple remover that provides in the apparatuses and methods of the prior art some of the advantages thereof, while simultaneously overcoming some of the disadvantages normally associated therewith, such as easy disposal of waste staples.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

The current invention is useful in making a neater workplace. A magnetic staple remover removes staples from paper or other materials and holds the waste staples until a number are collected in the cup and they are dumped into the trash. This invention eliminates the inevitable scattering of staples found on the floor, carpet and desk because of the time that would be wasted by manually collecting each individual staple as it is removed.

Figure 1:
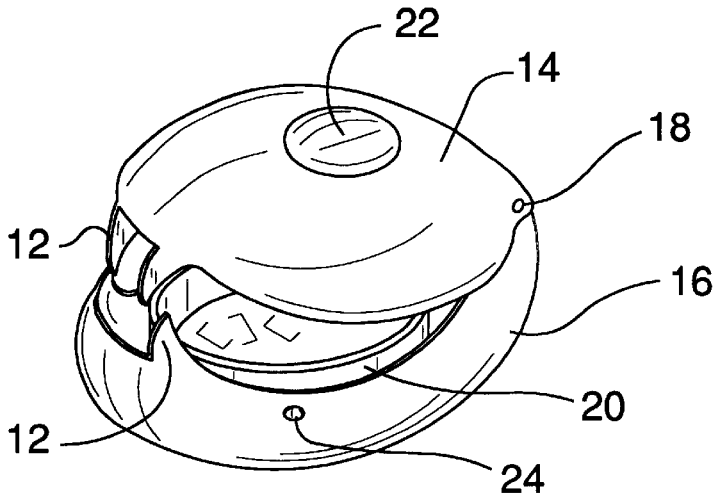
FIG. 1 is a perspective view of the preferred embodiment of the magnetic staple remover constructed in accordance with the principles of the present invention.
Figure 3:
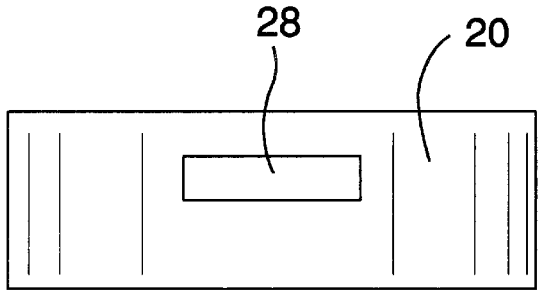
FIG. 3 is a side view of the interior cup of the magnetic staple remover of the present invention.
Figure 2:
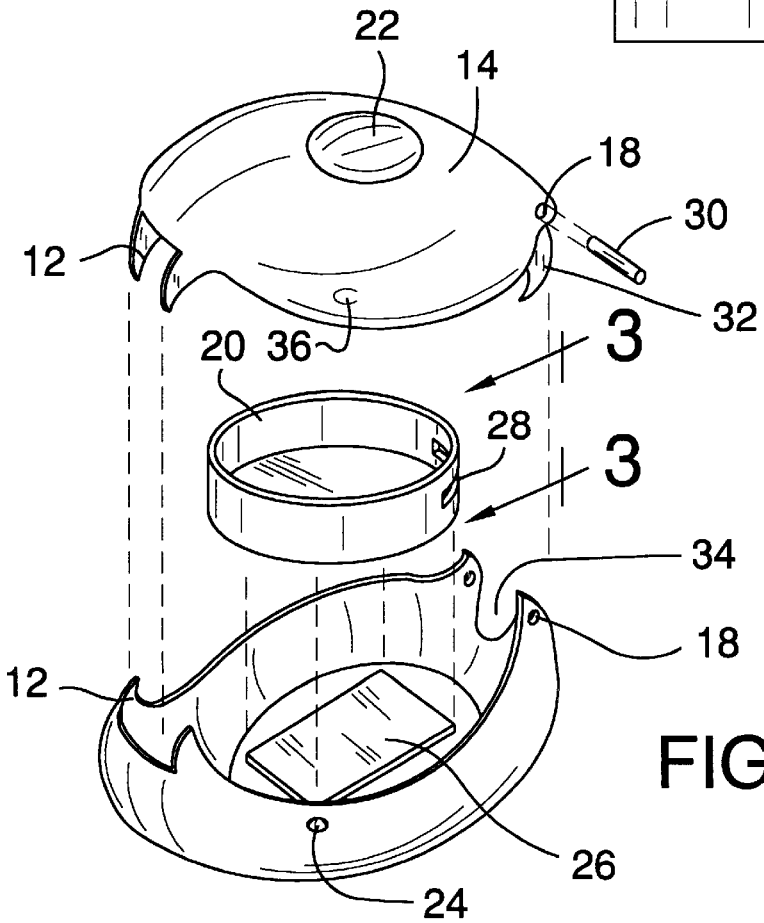
FIG. 2 is an expanded view of the magnetic staple remover of the present invention with the bottom hemisphere magnet and cup visible.

Referring now to the drawings, and particularly to FIGS. 1–3, a preferred embodiment of the magnetic staple remover of the present invention is shown and generally designated by the reference numeral 10. In FIG. 1, a new and improved magnetic staple remover 10 of the present invention for removing staples and retaining waste staples for disposal is illustrated and will be described. More particularly, the magnetic staple remover 10 has teeth 12 extending from the front of the staple remover body. The teeth 12 in the upper hemisphere 14 extend in a downwardly direction and the teeth 12 in the lower hemisphere 16 extend in an upwardly direction such that when the two hemispheres are closed from their pivotal attachment 18, the teeth 12 laterally engage one another. This permits the teeth to pass between a portion of the staple and outermost surface of the paper or other material from which the staple is being removed. The shape of the teeth 12 are substantially similar to the teeth of other staple removers known in the art. The staple is separated from the paper or other material and is directed into a cup 20 in the interior of the staple remover by a magnetic field.

The outer surface of the magnetic staple remover 10 shown in FIG. 1 has a gel grip 22 located on the top of the device for improved grip. This gel grip is preferably made from a gel or plastic material that is more malleable than the hard plastic casing comprising the staple remover body and may have ridges or other surface structures to facilitate an easy and comfortable grip. The gel grip may be the same color as the plastic casing or may be a different color. It may be clear or opaque.

The shape of the staple remover, when the upper hemisphere 14 is closed over the lower hemisphere 16 is oblate with a height substantially less than the width or depth. Preferably, the staple remover is circular. A recess 24 may be found in the of the lower hemisphere The body of the staple remover is preferably made out of a hard plastic, which may be molded by methods well known in the art. The teeth are preferably formed from metal and the magnet 26 is a ferrous material that is smaller in diameter than the lower hemisphere and is preferably relatively thin but strong enough to create magnetic field capable of pulling staples from the teeth 12 into the cup 20 when the cup 20 is place over the magnet.

FIG. 2 illustrates the position of a magnet 26 attached to the lower hemisphere 16. The magnet 26 may be square or round and is attached to the interior bottom surface of the lower hemisphere. The interior cup 20 is located directly above the magnet 26 and fits into the interior of the lower hemisphere 16. The cup 20 has a slot 28 in the rear and the upper hemisphere has an ejection tit 32. When the staple remover is fully opened for staple disposal, the ejection tit 32 passes through a slot 34 in the lower hemisphere 16 and into the slot 28 in the cup 20. The ejection tit 32 then moves the cup 20 and reduces the magnetic field between the magnet 26 and the staples in the cup 20 for easy staple disposal.

A pin 30 can be seen connecting the two hemispheres of the staple remover at the pivotal point 18 and allowing for pivotal movement of the two hemispheres. A ball detent 36 is found on the upper hemisphere corresponding to the recess 24 on the lower hemisphere. This can be used to lock the two hemispheres of the staple remover together. The two hemispheres of the staple remover may also be pivotally connected using a ball detent mechanism or any other pivotal connecting mechanism known in the art.

The cup 20 seen from the back can be seen in FIG. 3 where the slot 28 can be seen. In one embodiment, the cup 20 is short and has right angles between the flat bottom surface and the walls. Alternatively, the cup may be rounded, having a bowl-like design. For this design, the bottom interior surface of the lower hemisphere 16 is also rounded so that the cup 20 fits into the lower hemisphere over the magnet.

In use, it can now be understood that the two hemispheres of the magnetic staple remover 10 can be pressed together in a manner that the upper and lower teeth 12 dislodge a staple from paper or other materials. The waste staple then travels into the cup 20 due to the magnetic field created by the ferrous material 26 below the cup 20. When the cup 20 becomes full of staples, the user empties the cup 20 by opening the staple remover to expose and separate the cup and dumping out the staples.

While a preferred embodiment of the magnetic staple remover has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as a variety of plastic, wood or metal such as aluminum or steel may be used instead of the hard plastic described forming the body and teeth. In addition, although staple remover with one magnet in the lower hemisphere has been described, it should be appreciated that the magnetic staple remover may comprise a second magnet and a second cup located in the upper hemisphere and optionally a second gel grip on the lower hemisphere to create a device that has neither a top nor a bottom.

As used herein, the terms "approximately" and "about" means within 25% of the stated value, or more preferentially within 15% of the value. As used herein in the claim(s), when used in conjunction with the word "comprising", the words "a" or "an" may mean one or more than one. As used herein "another" may mean at least a second or more.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A magnetic staple remover comprising:

an upper hemisphere having an exterior surface, an interior surface, a front face, and a rear face, wherein teeth extend from said front face;

a lower hemisphere having an exterior surface, an interior surface, a front face, and a rear face wherein teeth extend from said front face, the rear face being pivotally attached to said rear face of said upper hemisphere;

a magnet on said interior surface of said lower hemisphere; and a cup fitting into said lower hemisphere above said magnet.

2. The magnetic staple remover of claim 1, further comprising a gel grip on the top of said upper hemisphere.

3. The magnetic staple remover of claim 2, wherein said exterior surfaces of said upper and lower hemispheres are colored plastic.

4. The magnetic staple remover of claim 3, wherein said gel grip is colored a different color than said upper and lower hemispheres.

5. The magnetic staple remover of claim 1, wherein the diameter of said upper and lower hemispheres is approximately 4–5 inches.

6. The magnetic staple remover of claim 5, wherein said staple remover is approximately 2.5 inches tall.

7. The magnetic staple remover of claim 1, wherein said pivotal attachment comprises a pin and a spring.

8. The magnetic staple remover of claim 1, wherein said pivotal attachment comprises a ball detent and recess.

9. The magnetic staple remover of claim 1, wherein said magnet is disk shaped.

10. The magnetic staple remover of claim 1, wherein said magnet is rectangular.

11. The magnetic staple remover of claim 1, wherein said cup further comprises a slot.

12. The magnetic staple remover of claim 11, wherein said upper hemisphere further comprises an ejection tit, wherein said ejection tit is adapted to rotate into said slot when said upper hemisphere is rotated away from said lower hemisphere.

13. The magnetic staple remover of claim 1, wherein said teeth on said lower hemisphere are spaced farther apart than said teeth on said upper hemisphere, and the sides of said upper and lower teeth slide into contact when said pivotal attachment is closed.

14. The magnetic staple remover of claim 1, wherein said teeth on said upper hemisphere are spaced farther apart than said teeth on said lower hemisphere, and the sides of said upper and lower teeth slide into contact when said pivotal attachment is closed.

15. A magnetic staple remover comprising:

an upper hemisphere having an exterior surface, an interior surface, a front face, and a rear face, wherein teeth extend from said front face and an ejection tit extends from said rear face;

a lower hemisphere having an exterior surface, an interior surface, a front face, and a rear face wherein teeth extend from said front face, the rear face being pivotally attached to said rear face of said upper hemisphere;

a magnet on said interior surface of said lower hemisphere; and a cup fitting into said lower hemisphere above said magnet, said cup comprising a slot, wherein said ejection tit is adapted to rotate into said slot when said upper hemisphere is rotated away from said lower hemisphere.

16. A method of removing a staple from a surface comprising:

inserting the teeth of a staple remover between said staple and said surface, said staple remover comprising:

an upper hemisphere having an exterior surface, an interior surface, a front face, and a rear face, wherein teeth extend from said front face;

a lower hemisphere having an exterior surface, an interior surface, a front face, and a rear face wherein teeth extend from said front face, the rear face being pivotally attached to said rear face of said upper hemisphere;

a magnet on said interior surface of said lower hemisphere; and a cup fitting into said lower hemisphere above said magnet;

pivotally closing said upper and lower hemispheres with the staple between the teeth of said staple remover, thereby unfolding said staple;

releasing said upper and lower hemispheres from the closed position, wherein said staple moves to said cup;

pivotally opening said upper and lower hemispheres until said cup is exposed; and removing said staple from said cup.

17. The method of claim 16, wherein said cup further comprises a slot.

18. The method of claim 17, wherein said upper hemisphere further comprises an ejection tit, wherein said ejection tit is adapted to rotate into said slot when said upper hemisphere is rotated away from said lower hemisphere.

* * * * *